US005971787A

United States Patent [19]

Brown

[11] Patent Number: 5,971,787

[45] Date of Patent: Oct. 26, 1999

[54] CONNECTOR ASSEMBLIES

[75] Inventor: Robert John Brown, Langley, United Kingdom

[73] Assignee: Smiths Industries Public Limited Company, London, United Kingdom

[21] Appl. No.: 09/103,375

[22] Filed: Jun. 24, 1998

[30] Foreign Application Priority Data

Jul. 3, 1997 [GB] United Kingdom ..... 9714007

[51] Int. Cl.[6] ..... H01R 4/38

[52] U.S. Cl. ..... 439/321

[58] Field of Search ..... 439/321, 320, 439/318, 349, 352, 306, 307, 308, 309, 310, 312, 313, 314, 350

[56] References Cited

U.S. PATENT DOCUMENTS

| | | | |
|---|---|---|---|
| 4,516,821 | 5/1985 | Nieman | 439/347 |
| 4,544,224 | 10/1985 | Goodman et al. | 439/321 |
| 4,597,621 | 7/1986 | Burns | 439/321 |
| 4,603,934 | 8/1986 | Burns | 439/319 |
| 4,605,271 | 8/1986 | Burns | 439/321 |
| 5,176,533 | 1/1993 | Sakurai et al. | 439/352 |
| 5,192,219 | 3/1993 | Fowler et al. | 439/321 |
| 5,195,905 | 3/1993 | Pesci | 439/352 |
| 5,366,383 | 11/1994 | Dearman | 439/321 |
| 5,707,252 | 1/1998 | Meszaros | 439/610 |

FOREIGN PATENT DOCUMENTS 2270805 3/1994 United Kingdom .

*Primary Examiner*—Paula Bradley
*Assistant Examiner*—Ross N. Gushi
*Attorney, Agent, or Firm*—Pollock, Vande Sande & Amernick

[57] ABSTRACT

A connector has a coupling nut rotatable on a body and lockable by means of a locking ring mounted on the nut. When slid axially to its locking position, the locking ring engages splines on both the nut and the body to prevent relative rotation. A circular spring carried in a groove on the nut engages behind a vertical wall on the inner surface of the locking ring to prevent the locking ring being unlocked. The locking ring is unlocked by pushing a release ring axially into the locking ring so that a ramp surface on the release ring pushes the spring in and allows the locking ring to be slid back.

6 Claims, 2 Drawing Sheets

CONNECTOR ASSEMBLIES

BACKGROUND OF THE INVENTION

This invention relates to connector assemblies.

The invention is more particularly concerned with lockable connector assemblies.

Where a connector assembly is to be used in conditions where it may be subject to vibration or other forces tending to separate the two parts of the assembly, it is desirable for the assembly to have some form of means for locking the two parts together. One example of a connector assembly provided with means for resisting uncoupling is described in GB 2270805 and is sold by Icore International Limited under the trade mark Optilock. This connector assembly has splines on the outer surface of two parts and a splined locking ring that can be slid over the splines on the two parts to prevent relative rotation between them. The splined locking ring is retained in the engaged position by means of a metal spring clip that engages a V-shape groove on the inside of the ring. To disengage the locking ring, the user pushes back the locking ring with a force sufficient to overcome the resilience of the spring clip. This arrangement is sufficient in most circumstances to provide a secure locking but, in some circumstances, it can be desirable to ensure that the locking ring cannot be inadvertently displaced to the unlocked position, as might happen, for example, if it were rubbed against another member.

BRIEF SUMMARY OF THE INVENTION

It is an object of the present invention to provide an improved connector assembly. The term connector assembly is used to cover any device connected on, or that serves to make connection to, a cable or the like.

According to the present invention there is provided a connector assembly including first and second components that are rotatable relative to one another, a locking member displaceable along the assembly between a first, unlocked position and a second, locked position where the locking member engages both components, a resilient member adapted to engage with the locking member and retain it in the second position, and a manually-displaceable member that is displaceable from a first location to a second location, the manually-displaceable member being arranged to engage the resilient member in the second location and displace it such as to permit movement of the locking member from the second to the first position.

The locking member is preferably a ring that is displaceable axially. The resilient member is preferable a circular spring. The locking member may have a vertical wall that engages with the resilient member in the second position and prevents movement of the locking member to the first, unlocked position unless the resilient member is displaced away from the wall by the manually-displaceable member. The manually-displaceable member preferably has a ramp surface arranged to contact the resilient member and displace it inwardly. The manually-displaceable member may be a ring movable axially between its first location and its second location. The locking member and the manually-displaceable ring are preferably mounted on the first component, the first component preferably having a projection on its external surface, the manually-displaceable ring being located between the locking member and the projection, and the manually-displaceable ring preferably being assembled on the first component by sliding over the projection. The manually-displaceable member may be of a plastics material.

A connector assembly according to the present invention, will now be described, by way of example, with reference to the accompanying drawings.

BRIEF DESCRIPTION OF THE DRAWINGS

Figure 1:
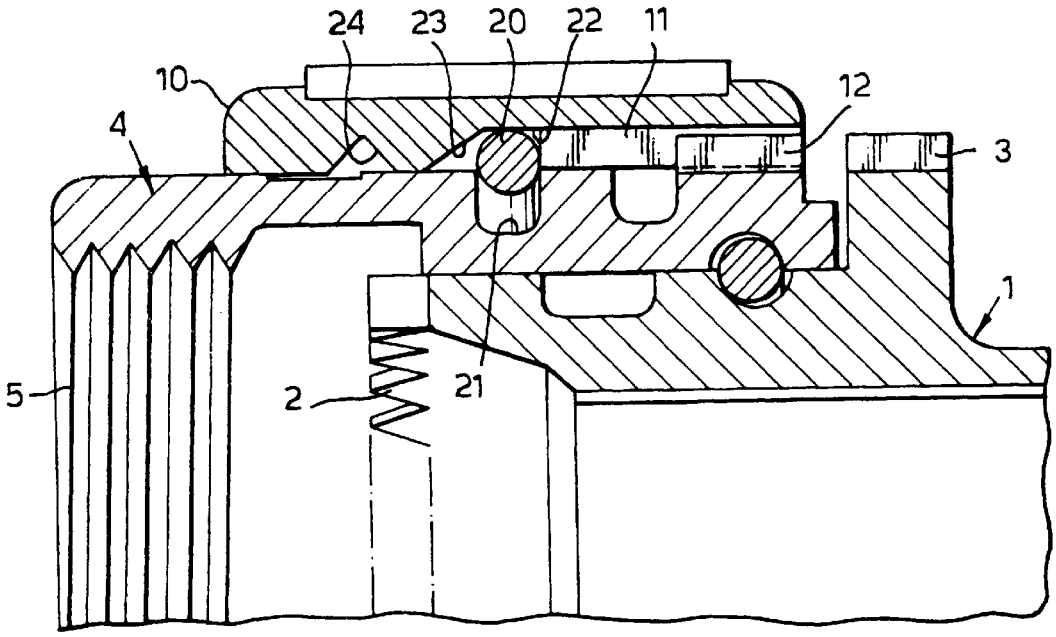
Fig.1. PRIOR ART
Figure 2:
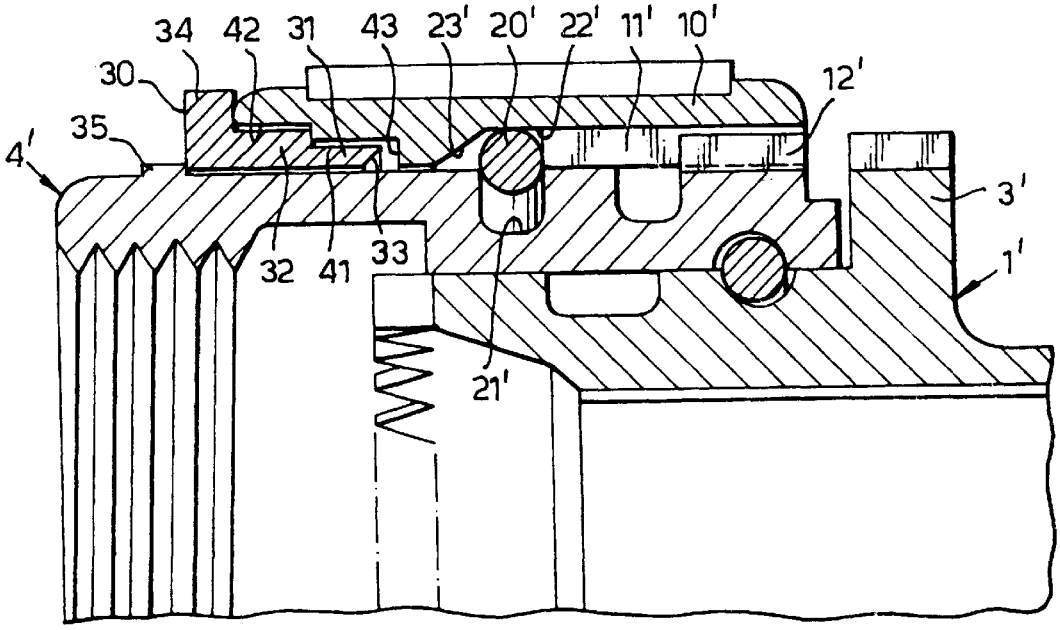
Figure 3:
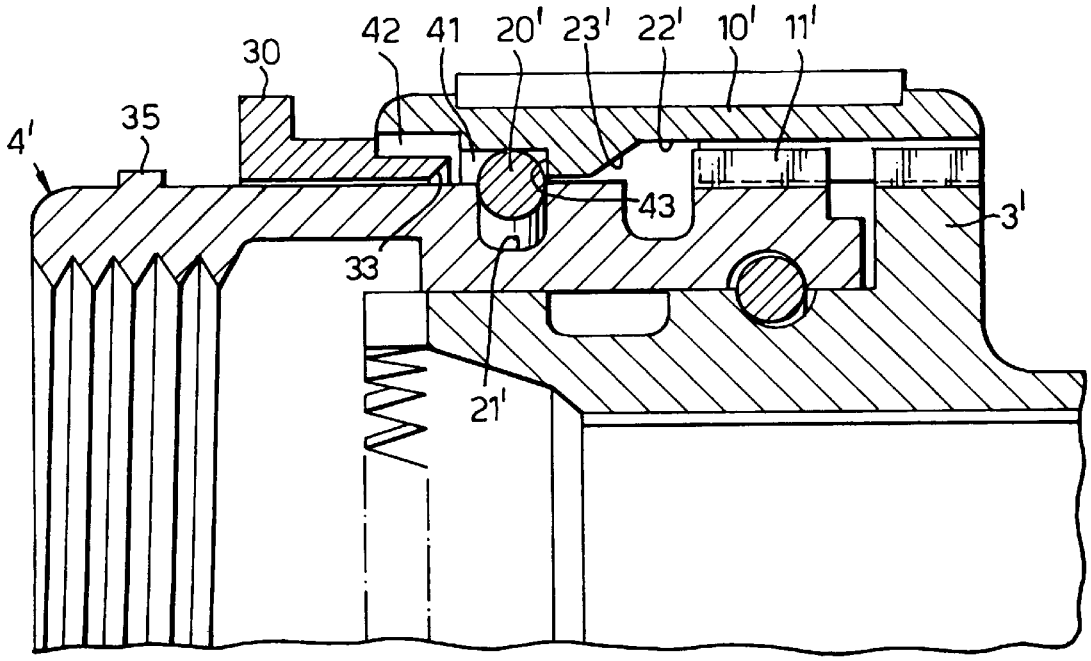
Figure 4:
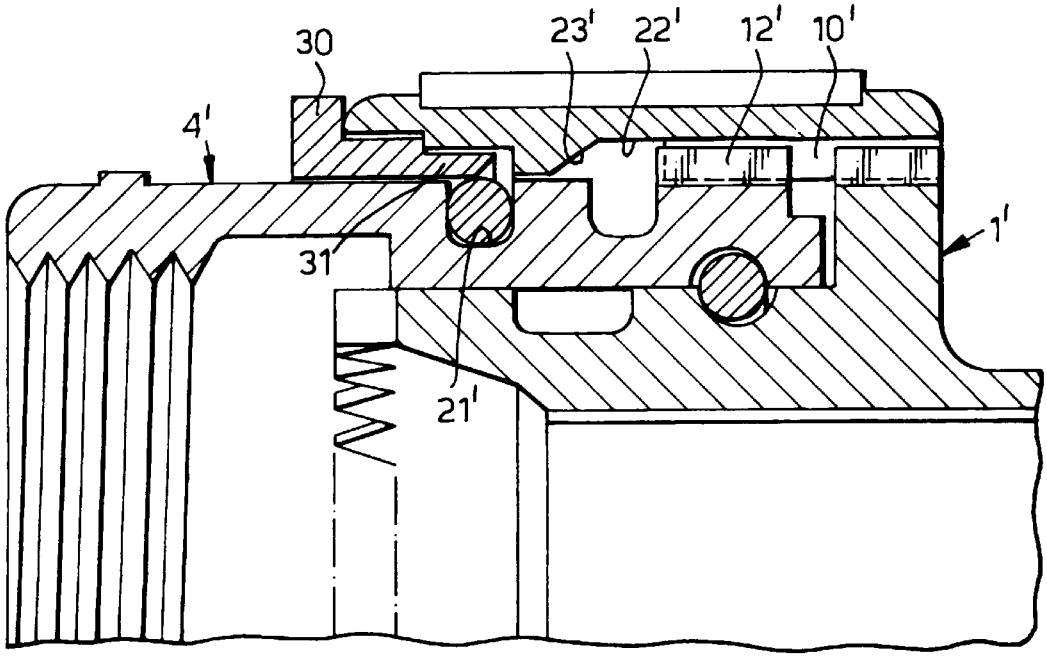

| | |
|---|---|
| Figure 1 | is a sectional side elevation view of a prior art assembly in the unlocked state; |
| Figure 2 | is a sectional side-elevation view of the assembly of the present invention in an unlocked state; |
| Figure 3 | is a sectional side elevation of the assembly of Figure 2 in a locked state; and |
| Figure 4 | is a sectional side elevation of the assembly of Figure 2 with the locking ring in a locked state but released for movement to an unlocked state. |

DESCRIPTION OF THE PRIOR ART

With reference first to FIG. 1, the prior art assembly has a cable clamp or body 1 of generally cylindrical form and is provided at its left-hand end with triangular teeth or castellations 2, which are adapted to mate with cooperating teeth on the main body of a connector, not shown. Towards its right-hand end, the cable clamp 1 has an externally splined region 3 extending circumferentially around the clamp. A coupling nut 4 is carried at the left-hand end of the clamp 1, the nut being freely rotatable about the clamp. At its left-hand end, the coupling nut 4 has an internal screw thread 5 adapted to engage an external thread formed on the main body of the connector. A locking ring 10 embraces the coupling nut 4, the locking ring being of generally cylindrical shape and mounted on the nut so that it can be displaced along its length. A splined region 11 extends around the inside of the ring 10 at its right-hand end and this engages with a splined flange 12 on the nut 4 so that the ring cannot be rotated relative to the nut. The length of the splined region 11, on the inside of the locking ring, is about twice that of the flange 12 so that the ring can be slid forwardly, to the right. When the locking ring 10 is slid forwardly, the splines 11 on the ring engage both splined flanges 3 and 12, thereby preventing the nut 4 being rotated relative to the clamp 1.

The nut 4 has a circular metal spring 20 in an annular groove 21. In the unlocked position shown in FIG. 1, the spring 20 is urged outwardly by its resilience into a recess 22 to the left of the splines 11 on the locking ring 10. Movement of the ring 10 further to the left is limited by engagement of the spring 20 with the left-hand edge of the splines 11. The locking ring 10 can be moved to the right, to a locked position, because the spring is forced inwardly into the groove 21 by an inclined ramp 23 at the left-hand end of the recess 22. When fully displaced to the right, the spring 20 snaps into a triangular recess 24 at the left-hand end of the locking ring 10. This provides a spring retention of the locking ring 10 in its locked position. Displacement of the locking ring 10 off the right-hand end of the nut 4 is prevented by engagement of the ramp 23 on the locking ring with the splines 12 on the nut. Further details of this assembly are given in GB2270805.

DETAILED DESCRIPTION OF THE PREFERRED EMBODIMENT OF THE INVENTION

With reference now to FIGS. 2 to 4, the assembly of the present invention is similar to the assembly of FIG. 1 except that it includes an additional component, namely a release ring 30, and the nut 4' and locking ring 10' are modified to cooperate with the release ring 30. Those features in this assembly equivalent to the assembly of FIG. 1 are given the same reference numeral with the addition of a prime'.

The release ring 30 is of a rigid plastics material, it is circular and is a close sliding fit on the rear, left-hand end of the nut 4'. The right-hand end of the release ring 30 is stepped externally, with a small diameter forward portion 31 and an enlarged intermediate portion 32. The forward tip of the release ring 30 has a tapered end surface 33, which increases in diameter forwardly so as to form an internally-directed ramp surface. The rear end of the release ring 30 has an enlarged, radially-projecting flange 34, which is accessible for manual engagement.

The forward end of the locking ring 10' is identical with that shown in FIG. 1. The rear of the locking ring 10', however, is modified on its inner surface, replacing the triangular recess 24 with a stepped region having a forward portion 41 and a rear portion 42 sized to receive the forward portion 31 and intermediate portion 32 respectively of the release ring 30. The forward end of the forward portion 41 has a wall 43 that extends vertically, that is, at right angles to the axis of movement of the locking ring 10'. As shown in FIG. 2, when the locking ring 10' is in its rear, unlocked position, the release ring 30 is inserted to its full extent in the rear of the locking ring, with the flange 34 abutting the rear of the locking ring. The forward end of the release ring 30 is separated from the wall 43 by a small gap. Rearward displacement of the release ring 30 and locking ring 10' is limited by a shallow shoulder 35 projecting externally from the nut 4'. The release ring 30 can be assembled on the nut 4' by pushing it forwardly over the shoulder 35 so that it snaps in position in front of the shoulder.

When the cable clamp 1' is assembled on the rear end of a connector and the nut 4' has been tightened, the locking ring 10' is pushed forwards, in the usual way to engage the splined flange 3'. As this happens, the spring clip 20' contacts the inclined ramp 23' and is pushed inwardly to the groove 21'. Further forward displacement of the locking ring 10' brings the wall 43 forwardly of the spring clip 20' so that the spring clip snaps outwardly into the forward portion 41 of the stepped region, as shown in FIG. 3. The locking ring 10' cannot be pushed rearwardly again because the inwardly-directed vector of the force applied by the vertical wall 43 will not be sufficient to overcome the force trapping the spring clip 20' against the rear edge of the groove 21'. The locking ring 10' can, however, be released by manually gripping the release ring 30 and pushing it axially forwardly fully into the locking ring 10' so that its tapered, forward tip 33 engages the spring clip 20' and pushes it inwardly into the groove 21', as shown in FIG. 4. The release ring 30 is held inserted in the locking ring 10' while the locking ring is pushed rearwardly to the position shown in FIG. 2, where the spring clip 20' can spring outwardly to its original position.

With the locking ring 10' in the locked position shown in FIG. 3, it cannot be displaced rearwardly to an unlocked position except by manual actuation of the release ring 30, thereby providing a very secure retention.

What I claim is:

1. A connector assembly comprising: a first component and a second component, said first component being rotatable relative to said second component; a locking member mounted on said first component and having a surface formation, said locking member being movable axially along the assembly between a first, unlocked position and a second, locked position where said surface formation of said locking member engages said second component to prevent relative rotation between said first and second components; a resilient member adapted to engage between said first component and said locking member to retain said locking member in said second locked position; and a manually-displaceable member mounted on said first component, said manually-displaceable member being movable from a first location to a second location, said manually-displaceable member being arranged to engage said resilient member when moved to said second location to displace said resilient member so as to permit movement of said locking member from said second, locked position to said first, unlocked position.

2. A connector assembly according to claim 1, wherein said locking member has a wall which engages with said resilient member in said second, locked position to prevent movement of said locking member to said first, unlocked position unless said resilient member is displaced away from said wall by said manually-displaceable member.

3. A connector assembly according to claim 1, wherein said manually-displaceable member has a ramp surface arranged to contact said resilient member and displace it inwardly when said manually-displaceable member is moved to said second location.

4. A connector assembly according to claim 1, wherein said manually-displaceable member is a ring that is movable axially between said first location and said second location.

5. A connector assembly according to claim 1, wherein said manually-displaceable member is of a plastics material.

6. A connector assembly according to claim 4, wherein said locking member and said manually-displaceable ring are mounted on said first component, wherein said first component has a projection on its external surface, wherein said manually-displaceable ring is located between said locking member and said projection, and wherein said manually-displaccable ring is a snap fit on said first component over said projection.

* * * * *